United States Patent [19]

Dalle

[11] 3,942,949

[45] Mar. 9, 1976

[54] PROCESS FOR THE TREATMENT WITH A FLUID OF TEXTILE MATERIALS IN THE FORM OF THREADS, SHEETS OF THREADS, SHEETS OF WEBBING OR IN ANY OTHER CONTINUOUS FORM

[76] Inventor: Jean-Paul Dalle, 1, rue du Capitaine Dumont, 02 St. Quentin, France

[22] Filed: July 26, 1974

[21] Appl. No.: 492,332

[30] Foreign Application Priority Data

Aug. 2, 1973 France ..... 73.28276

[52] U.S. Cl. ..... 8/125; 8/155

[51] Int. Cl.[2] ..... D06M 1/02

[58] Field of Search ..... 8/125, 155

[56] References Cited

UNITED STATES PATENTS

| | | | |
|---|---|---|---|
| 3,365,769 | 1/1968 | Brown et al. | 8/125 X |
| 3,406,006 | 10/1968 | Lindberg et al. | 8/125 |
| 3,767,359 | 10/1973 | Calamari et al. | 8/125 X |

*Primary Examiner*—Carman J. Seccuro

*Attorney, Agent, or Firm*—Curtis, Morris & Safford

[57] ABSTRACT

A process for the treatment with a fluid of textile materials in the form of threads, sheets of threads, sheets of webbing or in any other continuous form, the process being applicable in those cases where the final result does not depend on the duration of contact between the material and the fluid, provided this duration is above a minimum time. The process consists of bringing the material deposited on a carrier into contact with the fluid and of extracting the material continuously from this carrier while the action of the fluid on the material remaining on the carrier is made to continue.

The process is especially suitable to treating thread bobbins.

11 Claims, 1 Drawing Figure

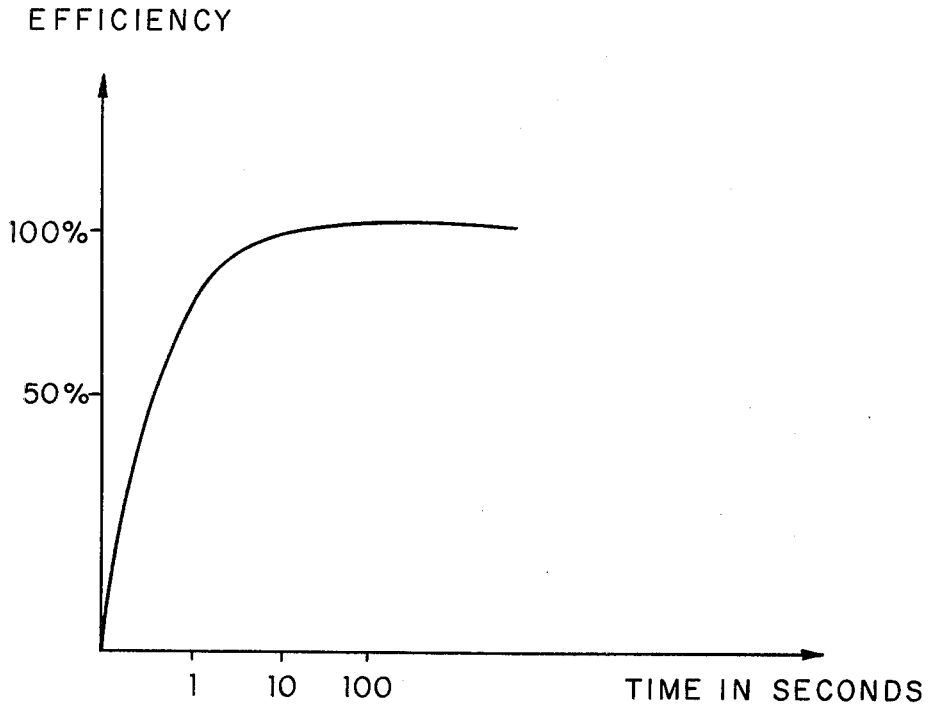
EFFICIENCY
100%
50%
1
10
100
TIME IN SECONDS

PROCESS FOR THE TREATMENT WITH A FLUID OF TEXTILE MATERIALS IN THE FORM OF THREADS, SHEETS OF THREADS, SHEETS OF WEBBING OR IN ANY OTHER CONTINUOUS FORM

The present invention relates to a process for the treatment with a fluid of textile materials having a continuous form such as threads, sheets of threads or sheets of webbing, the process being applicable in those cases where the final result does not depend on the duration of contact between the material and the fluid provided this duration is above the minimum time defined for each type of treatment.

The operations carried out on textile materials often consist of treating these materials with fluids, as a rule liquids such as dye-baths, bleaching agents, mercerizing agents or the like. Such treatments have been effected for a long time using discontinuous processes, that is to say by plunging the material into a bath during such a time and in such a form that the whole of the material is subject to the action of the fluid in the most uniform manner. The material is then removed from the treatment bath and squeezed and dried by any suitable means.

In order to increase productivity, numerous processes have been proposed for treating the material during the continuous advance movement thereof. The material, which is in different continuous forms, for example in the form of threads or woven material, is first made to travel through a treatment chamber and then a drying chamber. Such a process has been described, for example, in French Pat. No. 2,098,482 and its 1st Certificate of Addition No. 1,122,708.

The duration of the treatment, i.e. the time of contact between the fluid and the material necessary to obtain the desired result, is defined for each case and determines the choice of the running speed and the length of the treatment chamber. It is advantageous to use a high running speed, but this speed is limited by the actual constitution of the treatment chamber. So, in the case of a treatment time of 0.01 second and a running speed of 600 meters per minute, the chamber must have a length of 10 centimeters. If the duration of the treatment is extended, it becomes difficult, if not impossible, to use a continuous process.

While in numerous cases the result depends directly on the duration of the treatment, there exist treatments where the result is achieved with a rather long minimum treating time, comprised for example between 0.01 second and 10 seconds, without however being affected by a prolonged duration. If the efficiency of such a treatment, according to the time of contact, is illustrated graphically, one obtains a curve which attains an asymptote of 100% efficiency very rapidly. The desired result is the optimum result, that is to say one operates in the asymptotical part of the curve. The treatment of cellulosic materials with liquid ammonia is a good example of this type.

As the known processes are little applicable in this case, since they require very long treatment chambers or else low running speeds, the present invention has as its object a new continuous process applicable in this case.

To this end, the process consists in treating the material wound on to a bobbin or a roll by subjecting the outside of the bobbin or roll to the action of the fluid.

While the material is removed from the carrier, i.e. while the material is unwound, the action of the fluid continues on the material remaining on the carrier. The treatment can be effected by plunging the material into a tank containing the fluid or by spraying the fluid onto the material. The action of the fluid can be promoted by maintaining the tank under pressure. The fluid, which can be a gas or a liquid, is preferably removed from the material during the continuous advance movement thereof after removal from the carrier. If the fluid causes a shrinkage effect on the material and this is to be avoided, it is preferable to use a carrier which is least compressible on which the material is wound in a very close manner. Such a process is more especially suited to the treatment of cellulosic materials with liquid ammonia. It is this application, in the case where the material is in thread form, which will be described hereafter in order to make the invention better understood.

The attached graph shows schematically the action of liquid ammonia on a cellulosic material according to the time of contact of the material with the ammonia.

A thread bobbin is subjected to the action of liquid ammonia, for example by immersing it in a bath of liquid ammonia kept at a temperature lower than the boiling point of liquid ammonia. The ammonia may also be sprayed onto the bobbin by means of several spray nozzles regularly placed. The thread is then unwound while the bobbin is kept in the ammonia, and the ammonia removed during the unwinding process by any suitable means. The unwinding can be commensed as soon as the outside of the bobbin has been in contact with the ammonia for a time at least equal to the minimum time requested for a satisfactory result, that is 10 seconds.

When the bobbin is plunged into the bath, the ammonia penetrates into the bobbin to an extent which depends on the time of contact and the winding conditions. This penetration goes on during the whole upwinding process of the bobbin. Not all parts of thread are subjected to the action of the ammonia for the same duration. The outer layer of thread between the two ends of the bobbin is treated for a relatively short time. The parts of thread constituting these ends are treated for a much longer time. This period of time corresponds to that of the complete unwinding process as regards the part of thread located on the ends of the bobbin and which is in direct contact with the carrier. It has been found, nevertheless, that the thread so treated presents homogeneous properties along its whole length. This can be explained with reference to the attached graph.

In this graph, the time of action of the liquid ammonia on a cellulosic material has been reported on the $x$-axis using a logarithmic scale and the efficiency rate of the treatment on the $y$-axis. The efficiency rate can be determined, for example, by using the control method described in the American norm AATC No. 89 1958T. This method is based on the fact that the treated material absorbs more barium hydroxide than the untreated one. From this graph can be seen that beyond a treating time of about 10 seconds we are in the asymptotical part of the curve, and one then obtains the same efficiency rate of about 100% whatever the duration of this treatment. Tests have shown, moreover, that a relatively long duration of treatment does not at all damage the textile material. A thread bobbin of a metric count of 60/1 and which weighs about 1 kg is plunged into ammonia and then about 10 seconds after its immersion is unwound at a speed of 1000 meters per minute. It takes about 1 hour to unwind the whole bobbin. The contacting time of the thread with the ammonia varies between 10 seconds and 1 hour according to the location of the part of thread in the bobbin. It was found that the penetration of the ammonia into the bobbin is such as to impregnate about 100 grams of thread simultaneously. This penetration is sufficiently quick to allow each part of thread to be subjected to the action of the ammonia for more than 10 seconds. However, in the case of using considerably higher running speeds, the speed with which the ammonia penetrates into the bobbin could be increased, for example, by increasing the ammonia pressure.

Elimination of the ammonia can be brought about by any means, e.g. treatment with a hot fluid, passing through an oven, infra-red heating and such like. It is preferable to select a process for the elimination which may be applied to a thread running at high speed so as not to limit the overall speed of the particular treatment. The thread is then rewound unless further continuous treatments are to be applied.

It is known that the action of liquid ammonia can bring about significant shrinkage of the material. It is therefore necessary either to prevent this shrinkage, which is effected in the continuous processes already known by imposition of a great tension during the treatment, or to restretch the material subsequently, which entails, however, risks of yarn breakages.

It has appeared advantageous to prevent the shrinkage of the material, which is achieved very easily in a treatment according to the invention by using carriers which are least compressible to wind the thread on. It is preferable to effect the winding as close as possible. The mere tension of the thread on delivery during the unwinding and the drying is sufficient to allow any additional stretching to be avoided.

The process such as described here may be applied to any treatment whose efficiency can be illustrated by a curve as in the attached graph. The duration of the treatment can be varied, as the maximum efficiency, illustrated by the asymptotical part of the curve, is sought. It is sufficient that this duration is above a minimum time, which must be comprised between about 0.01 second and 10 seconds if such a process shall show up advantageously. This process may be used for the following applications, quoted as well by way of example:

pigment dyeing where the result does not depend on the duration of treatment but on the concentration of the bath, exhaust dyeing when a saturated shade is desired, anti-flame treatment, water repellent treatment.

It can be used for treating bobbins of thread, but also sheets of threads or woven fabrics wound on a carrier. The same as it would be possible to treat in this way loose fabrics, but one might meet with difficulties when extracting the material at high speed.

It is not necessary to render the material in a special form, the bobbin or roll being the most conventional presentation.

Such a process allows operating at very high running speeds while needing only simple impregnation installations. Moreover, the delivery of the thread can be interrupted momentaneously without difficulties. Also a variable delivery speed can be used, which is particularly advantageous when after treatment loose-wound bobbins are desired which have to be realized with a progressively increasing winding speed.

Further, the treating fluid can be a gas stored for example in an air-tight tank. In this case, as eventually in the case of a treatment with a liquid, removal of the treating fluid may prove unnecessary and the material can be made up directly after its continuous extraction from the treatment chamber.

The present invention is not limited to the above treating description, but covers all the variants thereof.

I claim:

1. A process for the treatment of textile materials in elongated continuous form by a treating fluid whose treating action is essentially independent as a practical matter of the time of contact beyond a minimum duration between about 0.01 seconds and 10 seconds, comprising:

continuously applying said treating fluid to the outside textile material would on a bobbin or roll, and continuously unwinding the bobbin or roll at a rate such that the unwound material is subjected to said treating fluid for at least said minimum duration while the action of the fluid continues on the material still wound, some of which has yet to be treated for said minimum duration.

2. A process in accordance with claim 1, wherein said material is treated by immersing the bobbin or roll into a tank containing the treating fluid.

3. A process in accordance with claim 2, wherein said tank is maintained under pressure.

4. A process in accordance with claim 1, wherein said treating fluid is sprayed on the outside of the bobbin or roll.

5. A process in accordance with claim 1, wherein said treatment fluid is a gas.

6. A process in accordance with claim 1, wherein said treatment fluid is a liquid.

7. A process in accordance with claim 1, wherein said treating fluid is removed during the continuous unwinding of the material.

8. A process according to claim 1, wherein said material is wound onto an essentially incompressible carrier.

9. A process according to claim 6, wherein said material to be treated is a cellulosic material and the treating fluid is liquid ammonia.

10. A process as claimed in claim 6, wherein said textile material has been subjected to the treating liquid for the minimum duration before being unwound.

11. A process as claimed in claim 7, wherein the treating fluid is a liquid and wherein the textile material may be unwound before having been contacted with the treating liquid for the minimum duration, but wherein the treating liquid is removed from the unwound textile material only after the minimum duration of contact.

* * * * *

UNITED STATES PATENT AND TRADEMARK OFFICE

CERTIFICATE OF CORRECTION

PATENT NO. : 3,942,949

DATED : March 9, 1976

INVENTOR(S) : Jean-Paul Dalle

It is certified that error appears in the above-identified patent and that said Letters Patent are hereby corrected as shown below:

Claim 1, line 26 (column 4), "would" should be --wound--.

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*